United States Patent [19]

Barbin

[11] 4,091,347

[45] May 23, 1978

[54] CONVERGENCE APPARATUS FOR IN-LINE BEAMS

[75] Inventor: Robert Lloyd Barbin, Lancaster, Pa.

[73] Assignee: RCA Corporation, New York, N.Y.

[21] Appl. No.: 667,834

[22] Filed: Mar. 17, 1976

[51] Int. Cl.[2] ..... H01J 29/68

[52] U.S. Cl. ..... 335/212

[58] Field of Search ..... 313/412; 335/210, 212

[56] References Cited

U.S. PATENT DOCUMENTS

| | | | |
|---|---|---|---|
| 2,923,844 | 2/1960 | Gundert | 313/412 |
| 3,808,570 | 4/1974 | Thompson et al. | 335/212 |
| 3,902,145 | 8/1975 | Slavenburg et al. | 335/212 |

*Primary Examiner*—A. D. Pellinen

*Attorney, Agent, or Firm*—Eugene M. Whitacre; Paul J. Rasmussen

[57] ABSTRACT

A first magnetic field producing member has its poles oriented for producing an initial predetermined movement of the two outside ones of three in-line beams of a cathode ray tube. Second and third field producing members are adjustable for producing variable strength and direction of magnetic fields for moving the two outside beams in opposite and the same directions, respectively, for converging the three beams.

9 Claims, 10 Drawing Figures

CONVERGENCE APPARATUS FOR IN-LINE BEAMS

BACKGROUND OF THE INVENTION

This invention relates to apparatus for converging three in-line beams of a cathode ray tube.

Color display systems such as utilized in color television receivers include a cathode ray tube in which three electron beams are modulated by color-representative video signals. The beams impinge on respective color phosphor areas on the inside of the tube viewing screen to reproduce a color scene as the beams are deflected to scan a raster. To faithfully reproduce a color scene the three beams must be substantially converged at the screen at all points on the raster. The beams may be converged at points away from the center of the raster by utilizing dynamic convergence apparatus or self-converging techniques, or a combination of both. No matter which arrangement is utilized to achieve convergence as the beams are deflected, some provision must be made to statically converge the undeflected beams at the center of the screen. Static convergence devices are necessary because tolerances in the manufacture of electron beam gun assemblies and the assembly of the electron gun into the picture tube neck frequently results in a static misconvergence condition.

U.S. Pat. Nos. 3,725,831 and 3,808,570 disclose static convergence assemblies for use with a cathode ray tube which produces three in-line beams. The assembly provides four-pole and six-pole magnetic fields for moving the outside two beams in opposite and in the same directions, respectively, with substantially no effect on the center beam. The strength of the fields produced and the direction of movement of the beams is controlled by rotating about the neck portion of the cathode ray tube a pair of four-pole members with respect to each other and in the same direction, respectively, with similar movement of a pair of six-pole members, which members have equidistantly spaced poles.

The above arrangements can satisfactorily statically converge three in-line beams of a color television picture tube. However, even with the poles of the various magnetic members oriented to produce predetermined field strengths and directions when initially mounted on the tube neck, variations in the initial observed beam landing pattern from one tube to another as described above prevents the operator from following an efficient procedure to statically converge the beams. This set-up problem occurs whether the magnetic members are postiioned by hand or are controlled mechanically by motor driven gears which engage gear teeth on the members, the motor being controlled by suitable switches accessible to the operator. The problem is accentuated when the beams are only slightly misconverged because only a little movement of the members in the wrong direction can produce an even greater misconvergence. The end result can be added cost of manufacture due to a relatively long set-up time or a less than optimum convergence condition, or both.

SUMMARY OF THE INVENTION

A convergence apparatus for three in-line beams of a cathode ray tube includes a first magnetic field producing member oriented for producing an initial predetermined movement of the two outside ones of the three beams. Second and third field producing members are adjustable for producing variable strength and direction magnetic fields for moving the two outside beams in opposite and in the same directions, respectively, for converging the three beams.

DESCRIPTION OF THE INVENTION

Figure 1:
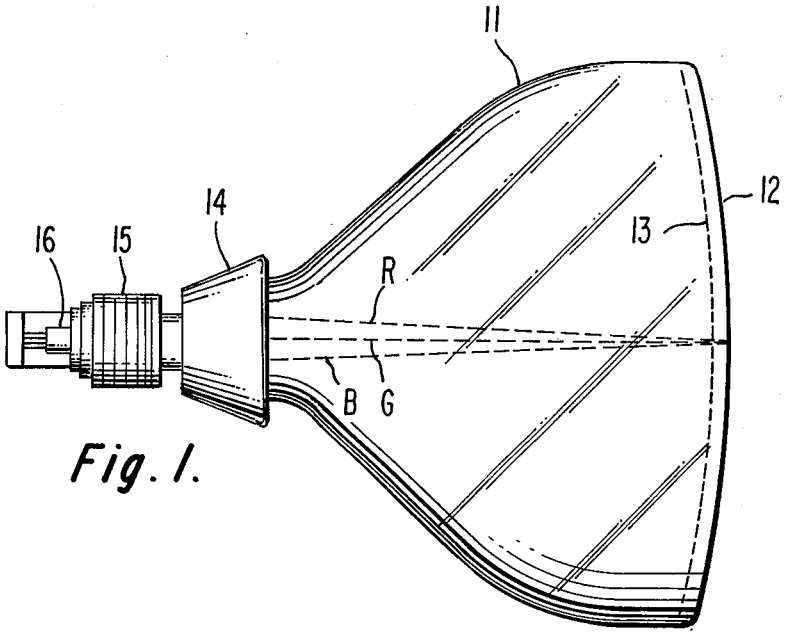
FIG. 1 is a partial top schematic view of a display system including a cathode ray tube and a beam convergence apparatus according to the invention.

In FIG. 1 a color television picture tube includes a glass envelope 11 having at its front a viewing screen 12 which includes color phosphor areas, not shown, on the inside surface thereof. Sapced slightly to the rear of the viewing screen 12 on the inside of the tube is a shadow mask 13 containing a plurality of apertures through which three electron beams pass to impinge on the color phosphors. Disposed around the neck portion of envelope 11 is a suitable deflection yoke 14 which when energized causes the three electron beams to scan a raster on viewing screen 12. An electron gun assembly 16 disposed within the neck portion of the tube produces three horizontal in-line beams R, G and B. Disposed over the electron gun region around the neck of envelope 11 is a static convergence and purity assembly 15.

Figure 2:
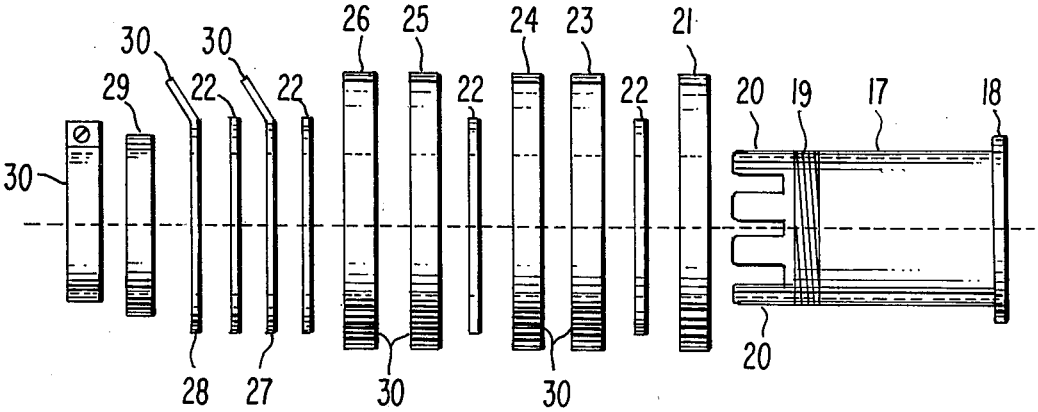
FIG. 2 is a disassembled view of the beam convergence apparatus of FIG. 1.

In FIG. 2 static convergence and purity assembly 15 is shown to include a hollow cylindrical member 17 which is adapted to fit over the neck portion of the picture tube as shown in FIG. 1. At one end of member 17 is an outwardly extending shoulder 18 and at the other end are a threaded portion 10 and a plurality of separated finers 20. A first magnetic ring member 21 fits over member 17 and is suitable indexed so as not to rotate about member 17 when assembled. A thin washer 22 of a suitable material such as paper separated a pair of four-pole magnetic ring members 23 and 24 from member 21. The four-pole ring members 23 and 24 are rotatable about member 17. Another washer 22 separates a pair of six-pole magnetic ring members 25 and 26 from the four-pole member 24. Ring members 25 and 26 also are rotatably adjustable about member 17. Another washer 22 separates a first purity ring magnet 27 from ring member 26 and is in turn separated from the second purity ring magnet 28 by another washer 22. A locking collar 29 fits on cylindrical member 17 and mates with the theads 19 to lock the rotatable magnetic members in position when they have been suitably adjusted. A clamp 30 is then assembled around fingers 20 to clamp cylindrical member 17 firmly to the neck portion of the glass envelope 11 of the picture tube. Each of ring members 23, 24, 25, 26, 27 and 28 has at least one projecting tab 30 to facilitate the rotating of the respective rings.

With the exception of the fixed four and six-pole ring member 21, the remainder of the static convergence and purity assembly is similar to the assemblies described in the aforementioned patents. Ring members 23 and 24 each have a pair of sourth magnetic poles diametrically separated and spaced 90° from a pair of diametrically opposed north magnetic poles. Rotation of four-pole ring members 23 and 24 in relation to each other varies the strength of the four-pole magnetic field and rotation of the ring members 23 and 24 together varies the direction of the four-pole magnetic field for suitably influencing the beams within the neck portion of envelope 11. Ring members 23 and 24 provide for opposite direction movement of the two outside ones of the three in-line beams with substantially no effect on the center beam.

Ring members 25 and 26 each include three magnetic north poles and three magnetic south poles, alternately and equiangularly spaced from each other by 60°. Rotation of ring members 25 and 26 in relation to each other controls the strength of the six-pole magnetic field and rotation of ring members 25 and 26 together about the neck of the tube controls the direction of the six-pole magnetic field within the neck portion of the picture tube. This six-pole field provides for movement of the two outside ones of the three in-line beams in the same direction with substantially no effect on the center beam.

Purity ring magnets 27 and 28 are of conventional type each having a pair of diametrically opposed north and south poles. Rotation of purity rings 27 and 28 causes movement of all three of the in-line beams in the same direction.

Figure 3:
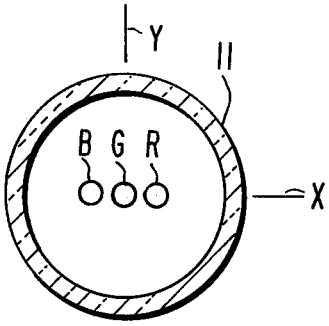
FIGS. 3–10 illustrate the beam convergence action of various members of the beam convergence apparatus of FIGS. 1 and 2.

FIG. 3 is a partial sectional view looking from the viewing screen of the picture tube into the neck portion of glass envelope 11 containing the electron gun which produces the three horizontal in-line beams B, G and R sequenced as shown and oriented as shown in respect to the horizontal and vertical axes X and Y.

Figure 4:
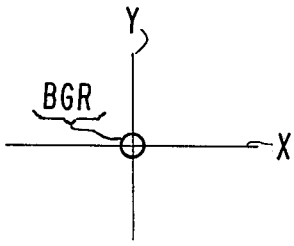
Figure 5:
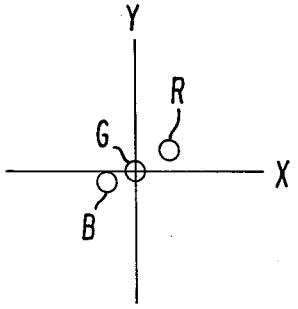

FIG. 4 illustrates a converged condition of the beams at the viewing screen in which the blue and red outside beams are converged on the center green beam. Ideally this is the condition of the beams produced by an ideal electron gun assembly perfectly mounted within a tube. As a practical matter as described above this condition cannot be realized in the absence of static convergence forces. A typical misconverged condition of the beams at the center of the screen might be as illustrated in FIG. 5. In FIG. 5 the green beam is shown at the center of the screen but the red beam is to the right and high and the blue beam is somewhat low and to the left. It should be understood that the typical misconvergence patterns at the center of the screen before the application of static convergence correction could be any arrangement of misconverged beams. Thus as described above, the operator performing the static convergence correction would not know which way the four and six-pole adjustable magnetic ring members should be adjusted.

Figure 6:
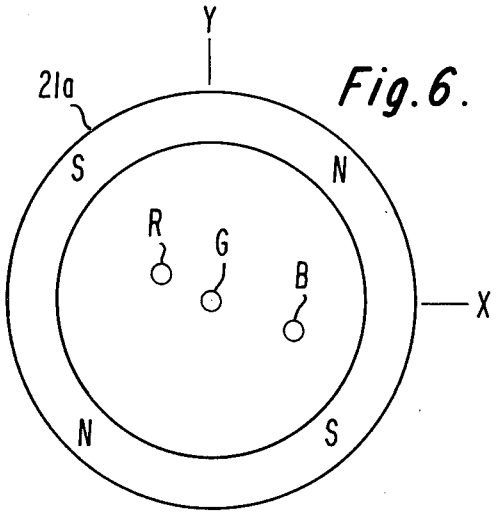
Figure 7:
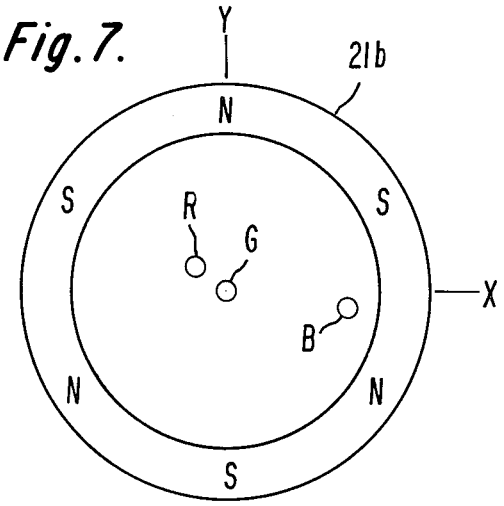

FIGS. 6 and 7 illustrate the effect produced by a first non-rotatable magnetic ring member assembly 21*a* and 21*b* on the beams. FIG. 6 shows a magnetic ring member 21*a* having north and south poles oriented at approximately 45° from the vertical and horizontal deflection axes as viewed from the screen of the picture tube. The effect of this four-pole field is to move the two outside beams in opposite directions a predetermined amount which is greater than any misconvergence of the beams shown in FIG. 5. By determining the forces acting on the beams by utilizing the right-hand rule method, it can be determined that from a starting position as illustrated in FIG. 5, the four-pole member 21*a* positions the beams as illustrated in FIG. 6. It is noted that the four-pole magnetic field has caused the blue and red beams to crossover in a horizontal direction.

In FIG. 7 the effect of a six-pole magnetic field produced by a non-rotatable six-pole ring member 21*b* having its poles oriented as illustrated with respect to the deflection axes is shown. Again by applying the right-hand rule it can be determined that the effect of the six-pole field is to move the red and blue beams in the same directon to the right in relation to the green beams as illustrated by the differences between the beam positions in FIG. 6 and FIG. 7. The strength of the four and six-pole fields produced by magnetic members 21*a* and 21*b* is selected to be large enough to cause the shift to the right of the beams and the horizontal crossover condition of the red and blue beams no matter what the initial misconverged beam landing pattern of FIG. 5 may be. thus, the ring members 21*a* and 21*b* always result in a predetermined offset in direction of the red and blue beams such as illustrated generally in FIG. 7.

Although the effects of the four and six-pole fixed magnetic fields have been shown separately in FIGS. 6 and 7, it is to be understood that the magnetic ring members 21*a* and 21*b* may be a single member as illustrated by member 21 of FIG. 2 and made of a magnetic material such as barium ferrite and magneetized with the combined four and six-pole magnetic fields.

Figure 8:
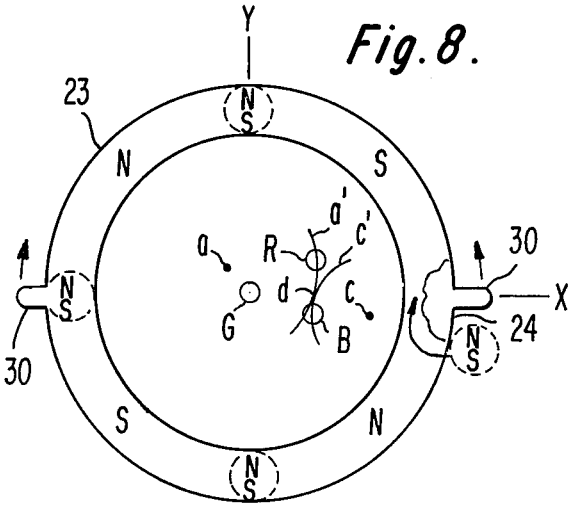

With the beams in the positions illustrated in FIG. 7, static convergence adjustment may now be made by the apparatus in accordance with the abovementioned patents. In FIG. 8 the two superimposed four-pole magnetic ring members 23 and 24 are illustrated. Initially the members 23 and 24 were positioned rotatably with respect to each other as illustrated by the pole arrangement within the dotted circles. Such overlapping of the north and south poles of the two rings would result in cancellation of the four-pole magnetic field. From this position the magnet rings are rotated in the opposite directions as indicated by the arrows adjacent to tab members 30 of the respective rings to produce the magnetic pole arrangement illustrated by the uncircled north and south pole designations of FIG. 8. This arrangement increases the strength of the four-pole field and moves the red and blue beams from the positions they occupied in FIG. 7 to the positions illustrated in FIG. 8. It is noted that this strength adjustment of the four-pole magnetic field with the poles oriented as indicated in FIG. 8 provides for a horizontal convergence of the red and blue beams.

Figure 9:
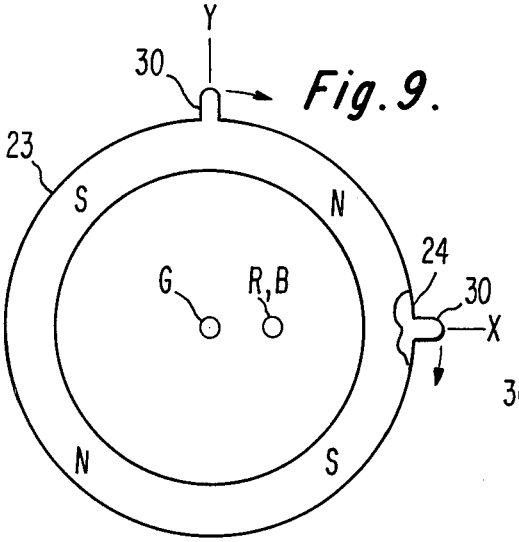

The next step in the static convergence adjustment is to simultaneously rotate the two four-pole ring members 23 and 24 in the same direction from the positions occupied in FIG. 8. For the particular beam configuration shown in FIG. 8, the required rotation would be a clockwise rotation of rings 23 and 24 through an angle equal to one-half the angle *a* line drawn between points *a* and *c* of FIG. 8 makes with the horizontal axis X. The effect of this rotation of both the rings is to cause the red beam to move in an arc *a'* struck from a point *a* and the blue beam to move in an arc *c'* from a point *c*. The points *a* and *c* of FIG. 8 corresponds to the position of the red and blue beams respectively as illustrated in FIG. 7. Movement of the red and blue beams along their respective arcs results in a convergence of the red and blue beams at the point *d* where the arcs *a'* and *c'* touch each other. Thus, the red and blue beams become converged as illustrated in FIG. 9.

Figure 10:
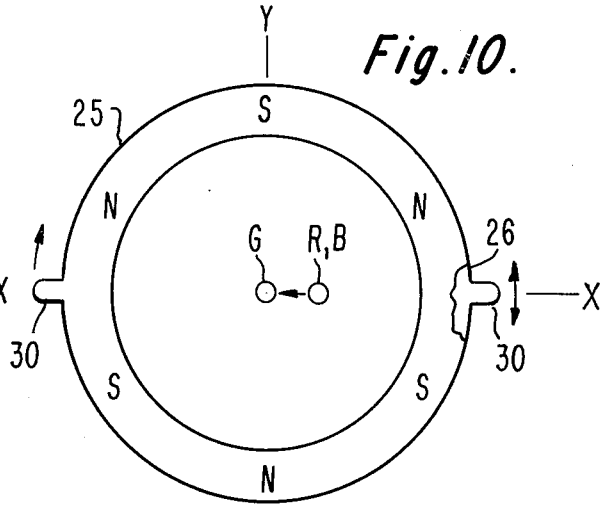

The next step is to vary the strength and direction, if required, of the six-pole magnetic field producing by ring members 25 and 26 in a manner similar to that described for the four-pole field in order to move the converged red and blue beams in the same direction, as indicated by the arrow in FIG. 10, to be converged with the green beam. The result will be a converged condition of the three beams as illustrated in FIG. 4. The starting position for the two six-pole rings 25 and 26, although not illustrated, was similar to that shown for the four-pole rings in FIG. 8 in that the north poles of one ring were superimposed on the south poles of the other so that initially no six-pole field existed. For reference, the overlapping poles would be located with the two top poles spaced 30° from the Y axis. With the red and blue beams positioned as illustrated in FIG. 10, the two six-pole ring members 25 and 26 would then be rotated in opposite directions with respect to each other until their orientation was such that the poles are as indicated in FIG. 10. This would provide the necessary direction of the six-pole field to move the red and blue converged beams as indicated in FIG. 10 by the arrow to be converged on the green beam. There is no need to rotate both of the six-pole rings simultaneously with the beam configuration illustrated in FIG. 9 as only a horizontal movement is required.

In the examples illustrated, the four and six-pole magnet rings 23–26 were rotated so that maximum strength fields were produced to simplify the number of separate poles illustrated in the drawings. As a practical matter it may be necessary to move a respective four or six-pole ring pair from the field cancelling position only part way towards the full field strength position.

In utilizing the invention described above, it is noted that the magnet rings may be moved by hand by means of the tabs illustrated or they may be moved mechanically as described above or by any other suitable means. In all cases, the advantage of the invention will be realized because the operator does not have to search for the proper direction in which to move the rings but may proceed from the initially oriented positioned as illustrated with the confidence that the beams will be moved in proper directions to affect convergence because of the predetermined positioning of the beams, no matter what the initial misconvergence pattern may be, caused by the fields produced by the fixed four and six-pole magnetic member 21.

What is claimed is:

1. A beam convergence apparatus for converging three in-line electron beams of a cathode ray tube, comprising:

first means for producing a non-adjustable magnetic field for moving the two outside ones of said three beams in predetermined directions in relation to the center one of said three beams;

second means for producing an adjustable magnetic field for converging said two outside beams; and third means for producing an adjustable magnetic field for converging said two converged outside beams onto said center beam.

2. A beam convergence apparatus according to claim 1 wherein said first means includes a single four-pole and a single six-pole field producing means, the poles on each means being equiangularly spaced.

3. A beam convergence apparatus according to claim 2 wherein said second means includes two rotatably mounted four-pole magnet assemblies for adjusting the strength and direction of said four-pole field, and said third means includes two rotatably mounted six-pole magnet assemblies for adjusting the strength and direction of said six-pole field.

4. A beam convergence apparatus for converging three in-line electron beams of a cathode ray tube, comprising:

first means for being mounted about the neck portion of said picture tube in a fixed position relative to the plane of said beams for producing a magnetic field for moving substantially only the two outside ones of said beams in predetermined directions;

second means for being mounted about said neck portion and being rotatably adjustable thereon for producing a magnetic field for moving substantially only said two outside beams in opposite directions; and third means for being mounted about said nck portion and being rotatably adjustable thereon for producing a magnetic field for moving substantially only said two outside beams in the same direction.

5. A beam convergence apparatus according to calim 4 wherein said first means includes means for producing a four-pole and a six-pole magnetic field.

6. A beam convergence apparatus according to claim 5 wherein said first means includes a single four-pole and a single six-pole field producing means, the poles on each means being equiangularly spaced.

7. A beam convergence apparatus according to claim 6 wherein said second means includes two rotatably mounted four-pole magnet assemblies for adjusting the strength and direction of said four-pole field, and said third means includes two rotatably mounted six-pole magnet assemblies for adjusting the strength and direction of said six-pole field.

8. A beam convergence apparatus for statically converging three in-line electron beams of a cathode ray tube on a central portion of the tube viewing screen, comprising:

first non-adjustable means for producing a magnetic field for moving substantially only the two outside ones of said beams to a fixed position;

second adjustable means for producing a magnetic field for moving substantially only said two outside ones of said beams in the same direction; and third adjustable means for producing a magnetic field for moving substantially only said two outside ones of said beams in opposite directions.

9. A beam convergence apparatus for statically converging three in-line electron beams of a cathode ray tube on a central portion of the tube viewing screen, comprising:

first means including a non-adjustable means for producing a four-pole and a six-pole magnetic field for moving substantially only the two outside ones of said beams to a fixed position;

second adjustable means for producing a magnetic field for moving substantially only said two outside ones of said beams in the same direction; and third adjustable means for producing a magnetic field for moving substantially only said two outside ones of said beams in opposite directions.

* * * * *

UNITED STATES PATENT OFFICE
CERTIFICATE OF CORRECTION

PATENT NO. : 4,091,347

DATED : May 23, 1978

INVENTOR(S) : Robert Lloyd Barbin

It is certified that error appears in the above-identified patent and that said Letters Patent are hereby corrected as shown below:

Column 2, line 19, that portion reading "sapced" should read -- spaced --; line 37, that portion reading "threaded portion 10" should read -- threaded portion 19 --; line 38, that portion reading "finers 20" should read -- fingers 20 --; line 39, that portion reading "suitable" should read -- suitably --; line 41, that portion reading "separated" should read -- separates --; line 63, that portion reading "sourth" should read -- south --; Column 6, line 16, that portion reading "nck" should read -- neck --; line 20, that portion reading "calim" should read -- claim --.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*